United States Patent [19]

Lüginbuhl

[11] 4,090,610

[45] May 23, 1978

[54] APPARATUS FOR REJECTING EXCESSIVELY THICK ARTICLES

[75] Inventor: Pierre Luginbühl, Neuhausen am Rheinfall, Switzerland

[73] Assignee: Sig Schweizerische Industrie-Gesellschaft, Neuhausen am Rheinfall, Switzerland

[21] Appl. No.: 784,792

[22] Filed: Apr. 5, 1977

[30] Foreign Application Priority Data

Apr. 9, 1976 Switzerland ..... 4548/76

[51] Int. Cl.[2] ..... B07C 1/10

[52] U.S. Cl. ..... 209/74 R; 209/82

[58] Field of Search ..... 209/73, 74 R, 82

[56] References Cited

U.S. PATENT DOCUMENTS

| | | | |
|---|---|---|---|
| 2,791,330 | 5/1957 | Carlson | 209/88 |
| 3,368,674 | 2/1968 | Koeppe | 209/79 |

*Primary Examiner*—Allen N. Knowles
*Attorney, Agent, or Firm*—Spencer & Kaye

[57] ABSTRACT

An apparatus for eliminating excessively thick elongated articles medially positioned on and advanced by a first conveyor in an orientation transverse to the direction of advance, comprises a sensor arranged above the first conveyor and responding to an article having a thickness exceeding a predetermined magnitude; and an impact mechanism connected to the sensor and having a striker positioned for delivering a blow to the excessively thick article for shifting the same into an eccentric position on and with respect to the first conveyor. The impact mechanism further has an actuating arrangement operating the striker upon receipt of a signal of response from the sensor. The apparatus also has a second conveyor formed of two parallel narrow conveyor belts extending from a discharge end of the first conveyor. The distance between the conveyor belts is less than the length of the articles. There is further provided an arrangement for transferring the articles from the discharge end of the first conveyor onto the second conveyor for effecting further conveyance of the medially arranged articles by the second conveyor by a stable engagement of the medially arranged articles with both conveyor belts and for effecting a dropout of the eccentrically arranged articles by an unstable engagement of the eccentrically arranged articles with the second conveyor.

11 Claims, 5 Drawing Figures

APPARATUS FOR REJECTING EXCESSIVELY THICK ARTICLES

BACKGROUND OF THE INVENTION

When articles such as candy bars are introduced into a wrapping machine, it is important to ensure a previous elimination of excessively thick articles. During the handling of articles prior to their wrapping, a fragment of a broken article may stick to another article. Should such an article of double thickness enter the wrapping machine, serious operational disturbance may occur which conceivably can lead to the damaging of the machine, apart from the unaesthetic appearance of such a wrapped article. Heretofore the articles advancing towards the wrapping machine have been visually monitored by a worker who manually removed the articles of excessive thickness. With the increase of the output of packing machines of this type, such a monitoring operation has become more and more difficult and the danger of damage to the machine has become more increasingly greater should the worker overlook an excessively thick article. To these disadvantages one should further add the cost of labor.

SUMMARY OF THE INVENTION

It is an object of the invention to provide an apparatus for the automatic rejection of excessively thick articles, thus eliminating the need of monitoring personnel.

This object and others to become apparent as the specification progresses, are accomplished by the invention, according to which, briefly stated, the apparatus for eliminating excessively thick elongated articles medially positioned on and advanced by a first conveyor in an orientation transverse to the direction of advance, comprises a sensor arranged above the first conveyor and responding to an article having a thickness exceeding a predetermined magnitude; and an impact mechanism connected to the sensor and having a striker positioned for delivering a blow to the excessively thick article for shifting the same into an eccentric position on and with respect to the first conveyor. The impact mechanism further has an actuating arrangement operating the striker upon receipt of a signal of response from the sensor. The apparatus also has a second conveyor formed of two parallel narrow conveyor belts extending from a discharge end of the first conveyor. The distance between the conveyor belts is less than the length of the articles. There is further provided an arrangement for transferring the articles from the discharge end of the first conveyor onto the second conveyor for effecting further conveyance of the medially arranged articles by the second conveyor by a stable engagement of the medially arranged articles with both conveyor belts and for effecting a dropout of the eccentrically arranged articles by an unstable engagement of the eccentrically arranged articles with the second conveyor.

DESCRIPTION OF THE PREFERRED EMBODIMENTS

Figure 1:
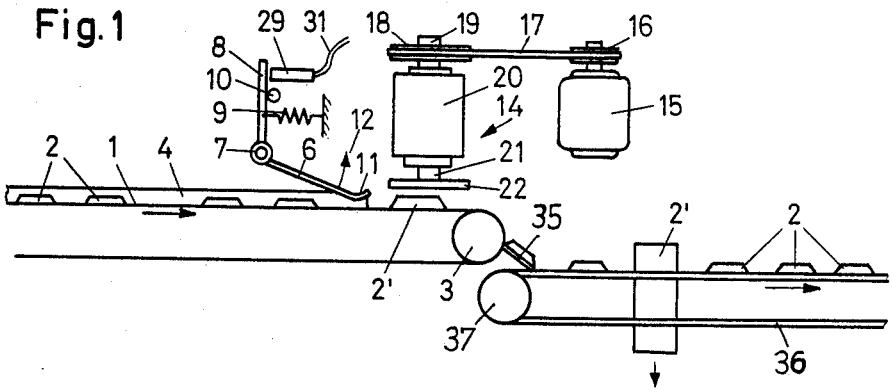
FIG. 1 is a schematic side elevational view of a preferred embodiment of the invention.
Figure 2:
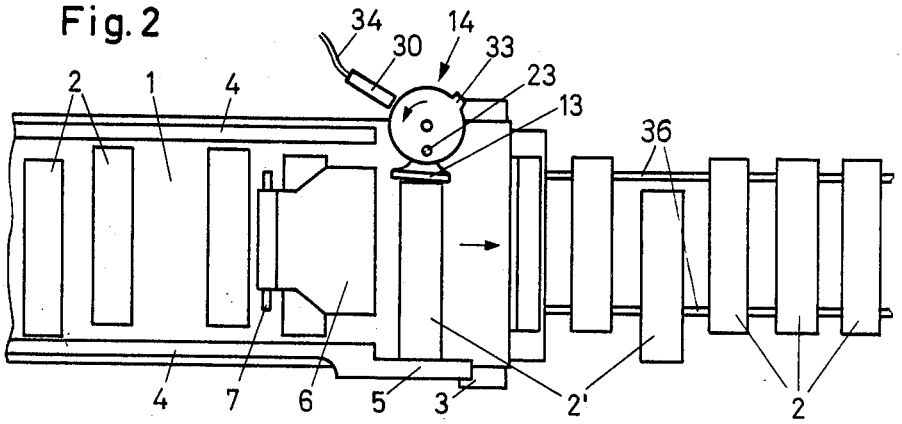
FIG. 2 is a top plan view of the structure illustrated in FIG. 1.

Turning now to FIGS. 1 and 2, the apparatus illustrated therein has an endless conveyor belt 1, the upstream or inlet end of which is charged, for example, by means of a slide, not shown, with articles 2, such as candy bars, in such a manner that they are arranged transversely to the direction of conveyance. The belt 1 is trained about rolls 3 (only the downstream roll 3 is shown), of which one is a driven roll. Bilaterally of the belt 1 there are arranged two guide rails 4 which may be attached, for example, to the machine frame. One of the guide rails 4 terminates in an outwardly staggered extension 5.

A sheet metal sensor lever 6 which extends approximately throughout the length of articles 2 in the width direction of the conveyor belt 1, and thus has a length, for example, which approximately corresponds to the distance between the two guide rails 4, is pivotally mounted on a horizontal shaft 7 arranged perpendicularly to the direction of conveyance. To the sensor lever 6 there is secured an arm 8 which is pulled against a stop 10 by means of a tension spring 9. The rounded terminus 11 of the sensor lever 6 has, in its position of rest determined by the stop 10, such a distance from the upper flight of the conveyor belt 1 that articles of normal (permissible) thickness may pass thereunder without contacting or pivoting the sensor lever 6. In case an article 2' has an excessive thickness or in case two articles are in a superpositioned relationship, the lever 6 is pivoted by such an article in the direction of the arrow 12 whereupon, as a result — as will be explained below — a hammer 13 hits one of the short sides of the article 2' immediately after the latter has left the zone of the sensor lever 6. By means of this lateral blow, the article 2' is shifted towards and stopped by the extension 5 of the guide rail 4, so that the article 2' assumes an eccentric position with respect to the discharge end of the conveyor belt 3. This occurrence — as it will also be described below — eventually results in the removal of the article 2'.

The hammer 13 constitutes a striker member of an impact mechanism generally indicated at 14. The latter further includes a continuously energized motor 15 which, by means of a driving pulley 16, a drive belt 17, a driven pulley 18 and an input shaft 19, drives a clutch and braking device 20 of conventional construction. On the output shaft 21 of the device 20 there is mounted a disc 22 on which there is eccentrically articulated the hammer 13 by means of a pin 23 shown in FIG. 3. The hammer 13 is inserted on the end of a bar 24 and is fixedly secured thereto by means of a pin 25. The bar 24 (shown broken off in its mid-portion) is, at its terminal portion remote from the hammer 13, slidably inserted in a throughgoing bore 26 of a pin 27 which is supported in a bearing 28 which, in turn, is stationarily attached to the machine frame (not shown).

The components 13 and 21 through 28 constitute a linear shuttling crank drive. In case the pin 23 assumes the position indicated at 23', the hammer 13 assumes a position of rest indicated at 13'. In this position the hammer 13 in no way obstructs the advance of the articles 2.

Figure 3:
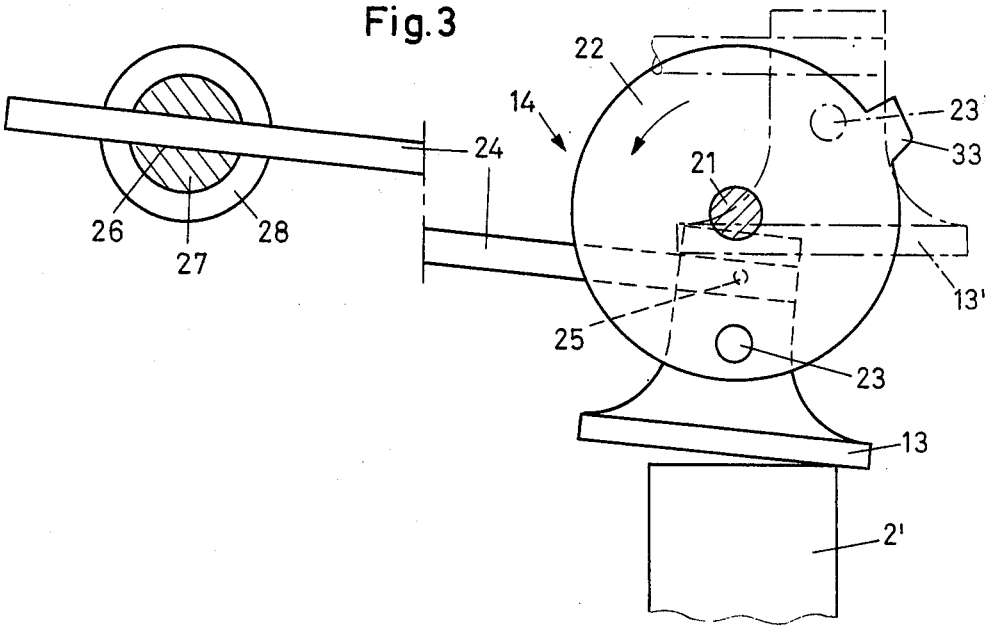
FIG. 3 is a top plan view, on an enlarged scale, of a detail of FIG. 2.

For controlling the clutch and the brake components of the device 20, there are provided proximity switches 29 and 30 positioned to cooperate with the arm 8 and a lug 33 of the disc 22, respectively. If the arm 8 of the sensor lever 6 moves away from the switch 29 because an excessively thick article 2' is passing thereunder, the switch 29, through conductors 31 and electromagnets arranged in the device 20, causes the clutch to close, whereupon the output shaft 21 and thus the disc 22 start to rotate in the direction of the arcuate arrow drawn into the disc 22 (FIGS. 2 and 3). The hammer 13 thus executes a blow; in its position shown in full lines in FIG. 3 has already hit the article 2' and thus shifted the latter into its eccentric position as shown in FIG. 2. By this time the sensor lever 6 has been brought back into its position of rest by the spring 9 and the clutch has been released due to the actuation of the switch 29 by the arm 8. In order to bring the disc 22, which continues to rotate by virtue of its inertia, into the correct position of rest, the brake arrangement contained in the device 20 has to be actuated. For this purpose the lug 33 which projects from the circumference of the disc 22 cooperates with the proximity switch 30. Shortly before the pin 23 reaches its predetermined position of rest 23', the lug 33 actuates the proximity switch 30 which thus effects energization of the brake via conductors 34 and an electromagnet; as a result, the brake rapidly stops the output shaft 21. The moment of braking is adjustable by shifting the switch 30 and/or the lug 33 in such a manner that by means of the braking operation the pin 23 arrives precisely into its predetermined position of rest 23'.

Were it possible to hit the excessively thick article 2' with the hammer 13, or a similar percussion member, with such a force that the article 2' would be propelled entirely off the conveyor belt 1, the problem of removal of the excessively thick article would be entirely resolved. But, to construct an impacting mechanism which, within a very short available time, is capable of delivering such a strong blow is practically unfeasible or is very uneconomical. The above-described impact arrangement 14 which may be constructed without difficulties and without excessive investment and which is relatively small and is well capable to satisfactorily operate even in case of a conveyance of 300 articles per minute. In order to utilize for a final removal, the eccentric position of the excessively thick articles 2' into which they were shifted by the relatively weak hammer blow, the following measures are taken:

At the discharge end of the conveyor belt 1 there is provided a slide 35 which is stationarily secured to the machine frame and from which the articles 2 arrive onto two parallel-spaced narrow endless belts or chains 36 which are trained around and driven by pulleys 37 (only one shown). The articles 2 which are in a normal position, that is, which are centrally arranged with respect to the belt 1 on the slide 35, fall onto both belts 36 and are thus further conveyed thereby. An article 2', however, which has been shifted by the blow of the hammer 13 up to the abutment 5, drops from the slide 35 only onto one of the belts 36. Thus, because of its imbalanced state, it tumbles down between the two belts 36 into a reject container (not shown).

Figure 4:
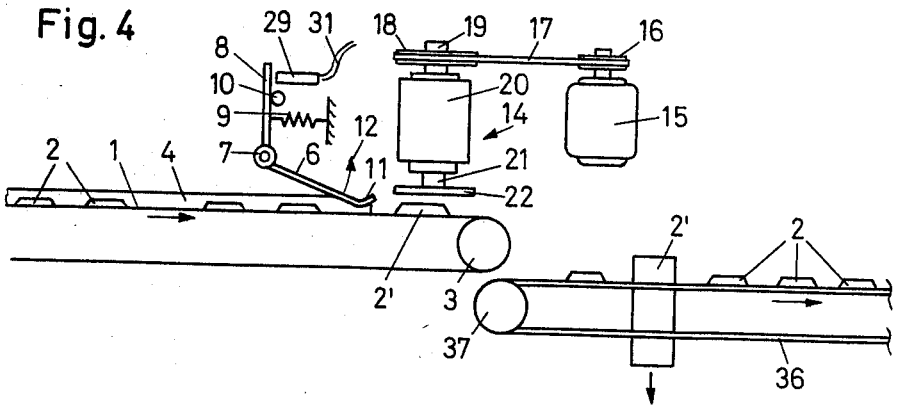
FIG. 4 is a schematic side elevational view of another preferred embodiment of the invention.

Turning now to FIG. 4, the embodiment illustrated therein is similar to that of FIG. 1 with the exception that the slide 35 is omitted altogether, whereby the articles 2 are transferred from the conveyor belt 1 to the narrow belts 36 by free fall.

Figure 5:
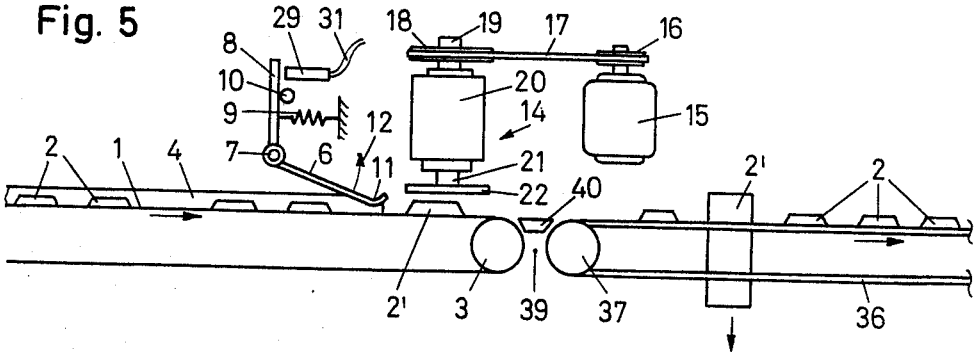
FIG. 5 is a schematic side elevational view of a further preferred embodiment of the invention.

A further arrangement for transferring the articles 2 from the conveyor 1 to the conveyor 36 is illustrated in FIG. 5. In this case the upper flights of the conveyors 1 and 36 are arranged substantially at the same horizontal level. In the space 39 between the discharge end of the conveyor 1 and the charging end of the conveyor 36 there is disposed a stationary connecting ramp 40 which may be secured, for example, to the frame of the apparatus and which has a surface arranged coplanar with the conveyors 1 and 36. Thus, the articles 2 are caused to slide by the conveyor 1 on the horizontal ramp 40. After the leading end of the articles is advanced onto the conveyor 36, the latter ensures that they are pulled off the connecting ramp 40, whereupon their conveyance is resumed by the conveyor 36 as described earlier in connection with the embodiment of FIG. 1.

The above-described apparatus may particularly find application in conjunction with conveyor arrangements that supply a packaging machine with articles to be wrapped. The above-described apparatus is preferably used downstream of an article orienting and sorting apparatus which has ensured that the articles are in a precise perpendicular orientation with respect to the article feed and articles shorter than a predetermined length (such as broken articles) were eliminated. The above-described apparatus (particularly if used in conjunction with an orienting and sorting apparatus) ensures a disturbance free operation of high-output wrapping machines.

It will be understood that the above description of the present invention is susceptible to various modifications, changes and adaptations, and the same are intended to be comprehended within the meaning and range of equivalents of the appended claims.

What is claimed is:

1. An apparatus for eliminating excessively thick elongated articles medially positioned on and advanced by a first conveyor means in an orientation transverse to the direction of advance comprising (a) a sensor means arranged above said first conveyor means and responding to an article having a thickness exceeding a predetermined magnitude;

(b) an impact means connected to said sensor means and having a striker means positioned for delivering a blow to the excessively thick article for shifting the same into an eccentric position on and with respect to said first conveyor means; said impact means further having actuating means operating said striker means upon receipt of a signal of response from said sensor means;

(c) second conveyor means formed of two parallel narrow conveyor belts extending from a discharge end of said first conveyor means; the distance between said conveyor belts being less than the length of the articles; and (d) an arrangement for transferring the articles from said discharge end of said first conveyor means onto said second conveyor means for effecting further conveyance of the medially arranged articles by said second conveyor means by a stable engagement of the medially arranged articles with both conveyor belts and for effecting a dropout of the eccentrically arranged articles by an unstable engagement of the eccentrically arranged articles with said second conveyor means.

2. An apparatus as defined in claim 1, wherein said actuating means of said impact means includes a motor, an output shaft connected to said striker means, and a clutch device for coupling said output shaft to, and uncoupling it from said motor; further comprising switch means arranged to respond to the state of said sensor means, and means for connecting said switch means to said clutch device for actuating said clutch device when said sensor means responds.

3. An apparatus as defined in claim 2, further comprising a brake device operatively connected with said output shaft for braking the same; and additional switch means arranged to respond to a position of said output shaft and connected to said brake device to actuate said brake device when said output shaft reaches said position.

4. An apparatus as defined in claim 3, wherein said sensor means includes a movably supported lever arranged above said first conveyor means for displacement by an excessively thick article passing underneath; further comprising an arm secured to said sensor lever and being movable therewith; said arm cooperating with said switch means; and a lug member arranged to rotate with said output shaft and cooperating with said additional switch means.

5. An apparatus as defined in claim 4, wherein said switch means and said additional switch means comprise first and second proximity switches, respectively.

6. An apparatus as defined in claim 1, wherein said impact means comprises a linear shuttling crank drive connected to and operating said striker means.

7. An apparatus as defined in claim 1, wherein said impact means further comprises an output shaft; means for rotating said output shaft; a disc affixed to said output shaft for rotation therewith; means for pivotally and eccentrically securing said striking means to said disc; a bar having a first end portion affixed to said striker means at a distance from its pivotal attachment to said disc; and a stationarily held pivotal support slidably receiving a second end portion of said bar.

8. An apparatus as defined in claim 1, wherein said striker means being arranged to deliver a blow in a transverse horizontal direction with respect to the conveying direction of said first conveyor means; further comprising abutment means situated laterally of said first conveyor means transversely from said striker means as viewed in said conveying direction to limit said eccentric position of the article shifted by said striker means.

9. An apparatus as defined in claim 1, wherein said arrangement for transferring the articles comprises the positioning of said second conveyor means at a level lower than said discharge end of said first conveyor means for effecting an article transfer by free fall from said first conveyor to said second conveyor.

10. An apparatus as defined in claim 1, wherein said arrangement for transferring the articles comprises the positioning of said second conveyor means at a level lower than said discharge end of said first conveyor means; and a slide arranged between the two conveyor means for effecting an article transfer on said slide by gravity.

11. An apparatus as defined in claim 1, wherein said arrangement for transferring the articles comprises the positioning of said second conveyor means spaced from, and at the same horizontal level as, said discharge end of said first conveyor means; and a connecting ramp disposed in the space between said first and second conveyor means and having a horizontal surface coplanar with said first and second conveyor means for effecting an article transfer on said surface of said connecting ramp by the advancing effect of at least said first conveyor means.

* * * * *